United States Patent [19]

Sandler

[11] Patent Number: 4,610,151

[45] Date of Patent: Sep. 9, 1986

[54] FABRIC DYEING MACHINE

[75] Inventor: Ben Z. Sandler, Beer-Sheva, Israel

[73] Assignee: B&D Designs Inc., New York, N.Y.

[21] Appl. No.: 731,864

[22] Filed: May 8, 1985

[51] Int. Cl.[4] ..... D06B 1/02; D06B 11/00

[52] U.S. Cl. ..... 68/205 R

[58] Field of Search ..... 68/205 R; 118/323; 427/286

[56] References Cited

U.S. PATENT DOCUMENTS

| | | | |
|---|---|---|---|
| 3,271,102 | 9/1966 | Morgan | 68/205 R X |
| 3,383,046 | 5/1968 | Voegtly | 118/323 X |
| 3,654,898 | 4/1972 | Galitz | 118/323 |
| 3,808,040 | 4/1974 | Barnes et al. | 427/286 X |
| 4,037,560 | 7/1977 | Lutz et al. | 68/205 R X |

FOREIGN PATENT DOCUMENTS

| | | | |
|---|---|---|---|
| 2758127 | 6/1979 | Fed. Rep. of Germany | 68/205 R |
| 1549763 | 8/1979 | United Kingdom | 68/205 R |

*Primary Examiner*—Philip R. Coe

*Attorney, Agent, or Firm*—Larson and Taylor

[57] ABSTRACT

A dyeing machine is provided which enables both longitudinal and transverse striping of a web of fabric to be dyed. The transverse striping station includes a plurality of dyeing nozzles carried by a carrier chain supported in a generally triangular configuration across the path of travel of the fabric. By suitably controlling the speed of travel of the nozzles relative to that of the fabric web, transverse striping of the fabric can be effected. Longitudinal stripes are produced by dyeing nozzles arranged in a row disposed across, and orthogonal to, the path of travel of the fabric web. These nozzles are ganged together for movement in unison to produce "wavy" longitudinal stripes.

19 Claims, 14 Drawing Figures

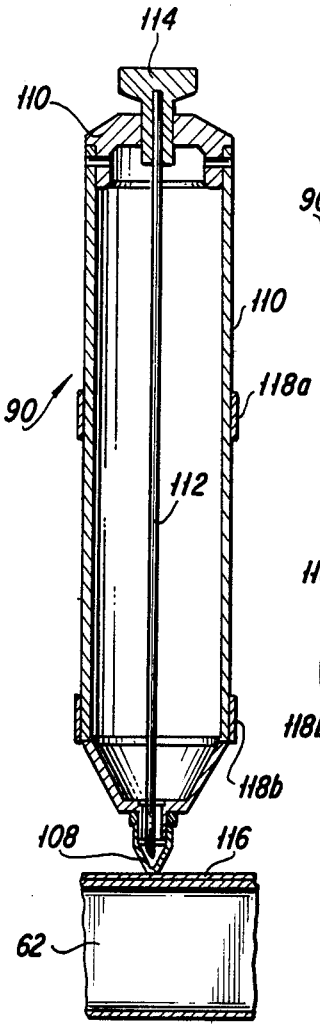
FIG. 9
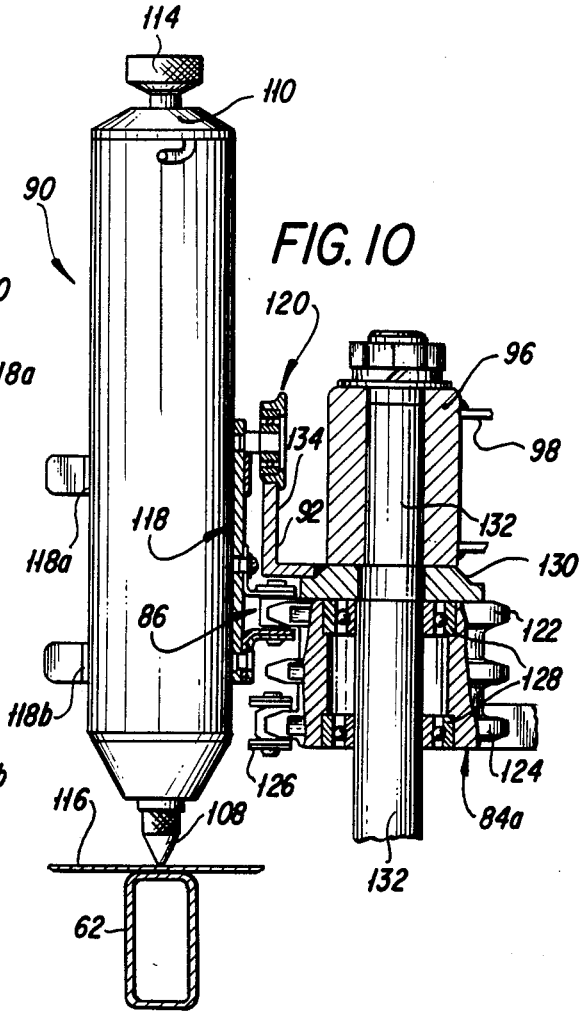
FIG. 10
FIG. 12
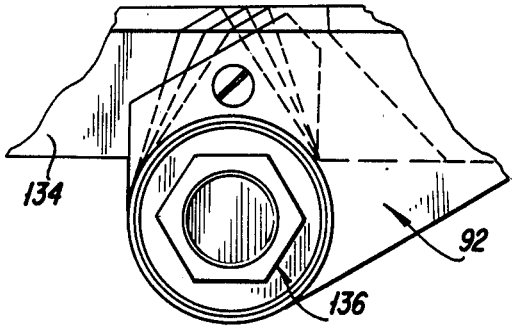
FIG. 11
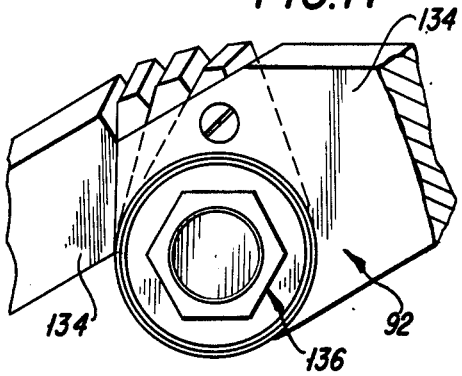
FIG. 13
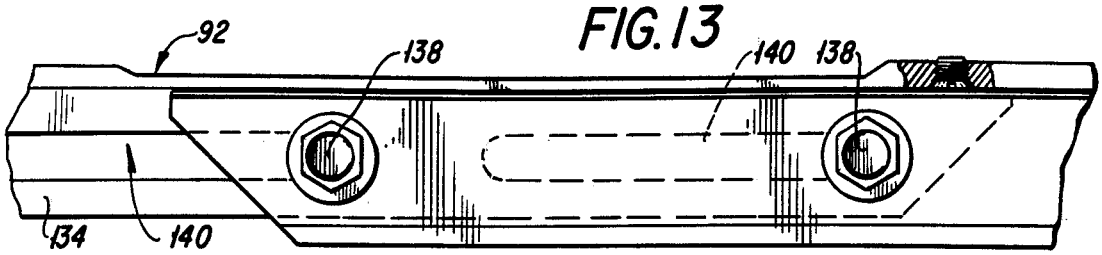

FABRIC DYEING MACHINE

FIELD OF THE INVENTION

The present invention relates to fabric dyeing and more particularly to an improved machine for fabric dyeing.

BACKGROUND OF THE INVENTION

A number of machines have been developed for dyeing of fabrics. Some examples of such machines are those disclosed in U.S. Pat. Nos. 3,975,151 (Berg et al), 4,000,904 (Newton) and 4,106,314 (Adrianjafy). Other patents relating to dyeing machines which are of possible interest include U.S. Pat. Nos. 2,218,811 (Chaussabel); 2,234,914 (James); 3,570,275 (Weber et al); 3,650,674 (Newton); 3,606,642 (Rigacci); 3,667,258 (Newton); 4,034,584 (Klein et al) 4,100,724 (Bous); 4,111,012 (O'Neill, Jr.); 4,202,188 (Gruber); and 4,392,366 (Godfrey), while U.S. Pat. No. 4,157,149 (Moen) discloses a multiple nozzle fluid (glue) dispenser of general interest. Patents such as the the Chaussabel and Jones patents concern dyeing machines wherein movement of the dyeing nozzles relative to the yarn or fabric to be dyed is provided so as to produce special patterns. In the Chaussabel patent a nozzle holder, which supports a plurality of dyeing nozzles and which extends transversely to the path of travel of the web of fabric, is reciprocated as the latter advances through the machine so as to obtain wavy or undulating stripe effects. In the Jones patent, a cross head carrying dyeing nozzles is reciprocated across the path of movement of the yarn and the stroke of the cross head can be varied to permit a variation in the pattern produced. The Bous patent discloses a dyeing machine wherein a series of nozzles is controlled so as to spray dye in different phase relationships. Others of the references referred to above disclose varying and controlling the dyeing pattern produced by regulating the dye flowing through the dyeing nozzles.

SUMMARY OF THE INVENTION

In accordance with the invention, an improved dyeing machine is provided which possesses a number of advantages over dyeing machines of the prior art particularly with respect to the provision of directional stripes on the web of material to be processed. The machine of the invention is very versatile and flexible in operation and is capable of readily producing a large number of different patterns and effects. On the other hand, the dyeing machine of the invention is relatively simple in construction and operation, and is robust and rugged in construction.

In accordance with one embodiment of the invention, a dyeing machine is provided which comprises: a first dyeing station; a second dyeing station; means for moving a web of material to be dyed, i.e., a web of cloth or fabric, along a predetermined path of travel past the first and second dyeing stations; transverse striping means at one of the stations for selectively applying transverse striping means at one of the stations for selectively applying transverse striping to the web of material and longitudinal striping means at the other of the two stations for selectively applying longitudinal striping to the web. The transverse striping means preferably includes at least one movable dyeing nozzle, a generally triangular guide disposed relative to the path of travel of the web so as to guide the movement of the dyeing nozzle in relation to the web so as to enable dying of the web by the nozzle; and means for moving the nozzle along the guide at a speed related to the speed of movement of the web such as to provide transverse striping of the web by the nozzle. The longitudinal striping means preferably comprises a plurality of dyeing nozzles arranged in a row extending transversely to the path of travel of the web.

In one embodiment, the dyeing nozzles are disposed above the path of travel of the web, while in a second, important embodiment, the dyeing nozzles are disposed below the path of travel of the web and hence spray the dyestuff upwardly onto the web.

In an advantageous embodiment, the at least one nozzle of the transverse striping means is mounted on a carrier chain, and the drive means includes a drive sprocket and a drive motor for driving the carrier chain. The carrier chain is preferably supported so as to form a triangle, with the drive sprocket being located at one apex of the triangle so formed and two further sprockets being located at the other apices of that triangle. According to an important feature of this embodiment, the two further sprockets referred to above are fixed in position, and at least one additional, adjustable sprocket is provided, the position of which is variable so as to adjust the tension on the carrier chain. Further, the guide means is also adjustable to accomodate adjustments of the position of the adjustable sprocket.

In the embodiment wherein the spray nozzles are directed downwardly, the nozzles each preferably comprise a reservoir for holding the dyestuff to be applied, a lower nozzle portion which is in communication with the reservoir and, which includes a nozzle outlet through which the dyestuff is ejected, and means for adjusting the amount of the dyestuff ejected through the nozzle outlet of the nozzle portion. Advantageously, the adjustment means comprises an elongate needle, and a control knob connected to the proximal end of the needle and located at the upper end of the nozzle for varying the longitudinal position of the distal end of the needle relative to the nozzle outlet to control the amount of dyestuff ejected.

In the embodiment where the nozzles are directed upwardly, the nozzles include a reservoir for the dyestuff to be applied and a pump for pumping the dyestuff from the reservoir through the nozzles.

The longitudinal striping means preferably comprises a plurality of individual pivoted supports for the nozzles which are linked together by connecting links and oscillated in unison to provide "wavy" stripes.

In accordance with a further aspect of the invention, a dyeing machine is provided for applying transverse stripes to a web of material, this machine comprising: means for moving a web of material to be dyed along a predetermined path; and transverse striping means for applying transverse stripes to the web, the striping means comprising a plurality of dyeing nozzles, means for connecting the nozzles together in spaced relationship and supporting the nozzles in a generally triangular configuration the base of which lies adjacent the path of travel of the web and the other two sides of which extend across the path of travel of the web, and drive means drivingly connected to the connecting means for moving the nozzles in sequence along a triangular path defined by the connecting means across the web at a predetermined speed relative to speed of the web such that the nozzles selectively apply a transverse stripe to the web during the movement thereof along said other sides across the cloth. In an important illustrative example, the triangle so formed is an equilateral triangle and the nozzles are moved at a speed which is twice that of the web. Advantageously, the transverse striping means further comprises a generally triangular guide for guiding the movement of the nozzles. The connecting means preferably comprises a drive chain which carries the nozzles and the drive means comprises a drive sprocket located at one apex of the triangle referred to above. The nozzles are each part of a nozzle assembly which preferably includes a laterally extending roller member which rides on the triangular guide. As discussed above, the transverse striping preferably includes means for adjusting the tension on the drive chain, thus tension adjusting means advantageously comprising at least one auxilliary adjustable sprocket the position of which can be varied to vary to tension on the drive chain. As was also discussed, means are preferably provided for adjusting the triangular guide so as to accomodate for changes in the position of the adjustable sprocket.

Other features and advantages of the present invention will be set forth, or apparent from, the detailed description of the preferred embodiments which follows.

BRIEF DESCRIPTION OF THE DRAWINGS

FIG. 9 is a side elevational view, partially in section, of a dyeing nozzle constructed in accordance with a preferred embodiment of the invention;

FIG. 10 is front view, partially in section, of the nozzle of FIG. 9, showing the drive and guide arrangement therefor;

FIGS. 11 and 12 are details of a portion of the guide arrangement for the nozzles of FIGS. 6 to 10 showing the two extreme positions thereof; and FIG. 13 is a further detail of the guide arrangement of FIGS. 6 to 12.

DESCRIPTION OF THE PREFERRED EMBODIMENTS

Figure 1:
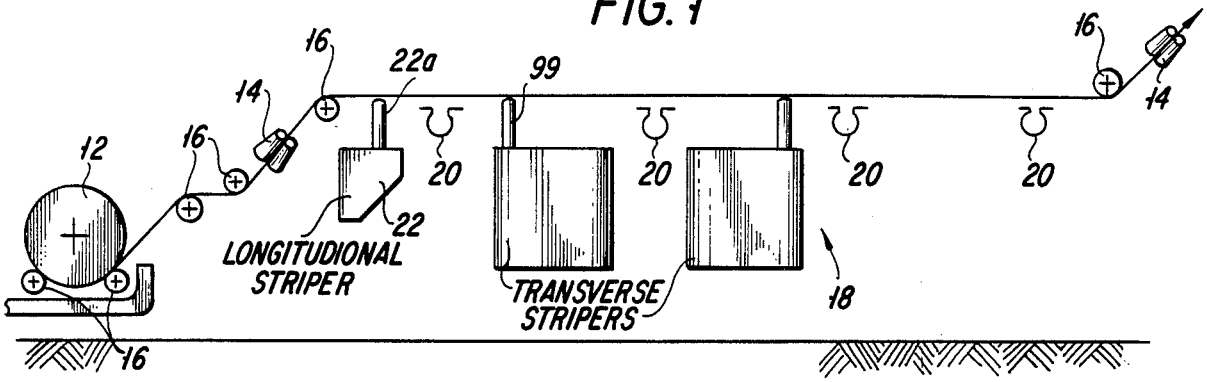
FIG. 1 is a highly schematic side elevational view, partially in block form, of a fabric dyeing machine constructed in accordance with a first embodiment of the invention.
Figure 2:
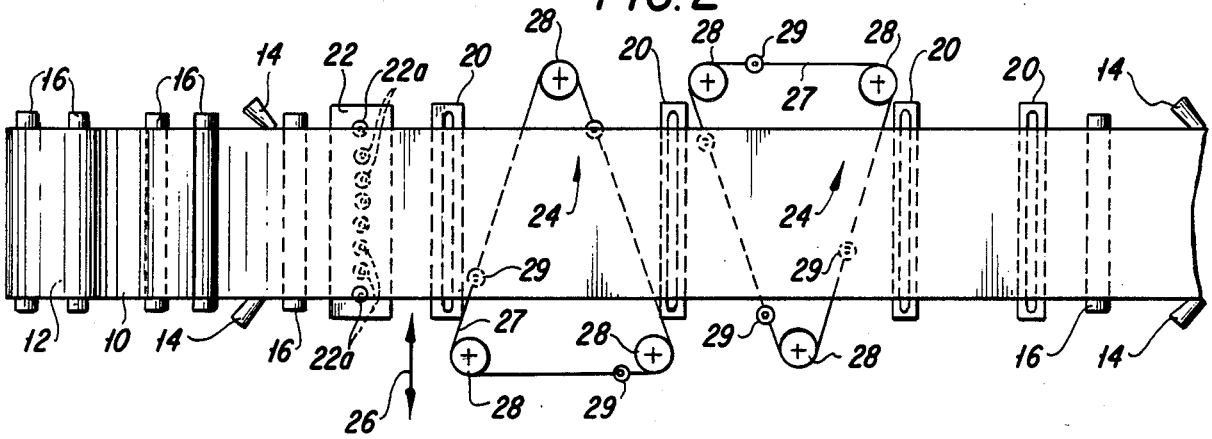
FIG. 2 is a plan view of the dyeing machine of FIG. 1.

Referring to FIGS. 1 and 2, there are shown, in a schematic manner, respective side elevational and plan views, partially in block form, of one embodiment of the invention. A sheet or web of cloth or fabric to be dyed, indicated at 10, is unreeled from a roll 12, and supported by a series of guide rollers 14 and support rollers 16 located at each end of a dyeing station or section generally denoted 18. The sheet 10 is supported during the travel thereof through dyeing station 18 by a series of spaced air supports or "air pillows" 20, which can also be used as dryers where hot or warm air is used to create the air cushion support.

Located within dyeing section 18 is a longitudinal striping device or striper 22 for creating stripes along the length of sheet 10 and two transverse striping devices or stripers 24 for producing stripes across, i.e., transverse to, the sheet 10.

Longitudinal striping device 22 comprises a series of nozzles 22*a* which are arranged transverse to the sheet 10 and which, when actuated, spray dyestuff therefrom the produce individual stripes along sheet 10. These nozzles 22*a* can be caused to move transversely of sheet 10 as indicated by double ended arrow 26.

Briefly considering the transverse striping devices 24, and referring particularly to FIG. 2, devices 24 each include a carrier member 27 which is of a generally triangular configuration and is supported at the corners thereof by sprockets 28 which provide movement of dye nozzles 29 carried by carrier member 27 in the generally triangular path illustrated. As shown, a portion of this path extends across the path of sheet or web 10 and thus by suitably controlling the speed of travel of the nozzles 29 relative to the web 10, transverse stripes can be produced on web 10. This operation is discussed in more detail below in connection with other embodiments of the transverse striping devices of the invention.

Figure 3:
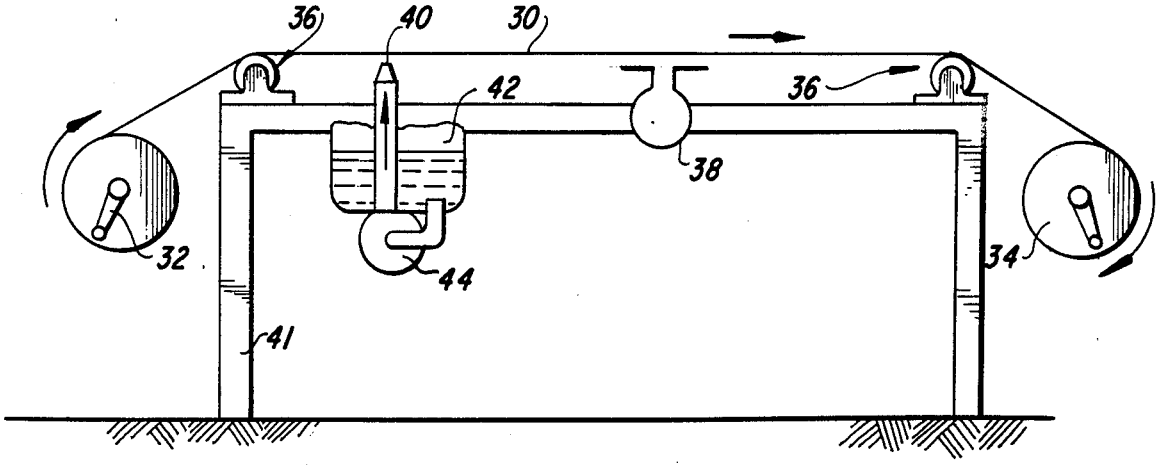
FIG. 3 is a highly schematic side elevational view of a dyeing machine constructed in accordance with a further embodiment of the invention.

Reference is now made to FIG. 3 which shows a further embodiment of the invention including a longitudinal striping device 28. In this embodiment, a sheet of fabric 30 is unwound from one roll 32 and is wound onto a second roll 34, the fabric sheet 30 being supported by support rollers 36 and an air support device 38, all mounted on a frame 41. Striping device 28 includes a nozzle 40, a dye tank or reservoir 42, and a pump 44 which pumps dye from tank 42 through nozzle 40. In this embodiment, as well as that of FIGS. 1 and 2, the nozzle 40, and the other nozzles described above, are directly upwardly, although the nozzles can also be directed downwardly as described hereinbelow in connection with other embodiments of the invention.

Figure 4A:
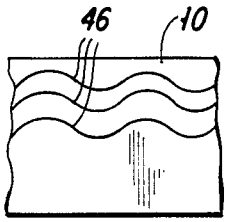
FIGS. 4(*a*) and 4(*b*) are representative patterns produced by the dyeing machine of the invention.
Figure 4B:
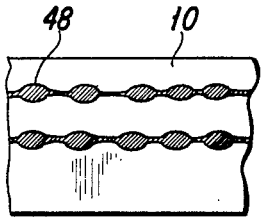

As illustrated in FIG. 4(*a*), wave-like longitudinal striping, denoted 46, can be produced by transverse movement of the nozzle 22*a* of longitudinal striping device 22 (or of nozzle 40 of FIG. 3). Further, as illustrated in FIG. 4(*b*), and with particular reference to FIG. 3, by controlling the amount of dye pumped to nozzle 40, the width of the longitudinal stripes produced can be controlled as indicated by stripes 48. It will be understood that the examples shown in FIGS. 4(*a*) and 4(*b*) are merely representative of a large number of patterns that can be produced.

Figure 5:
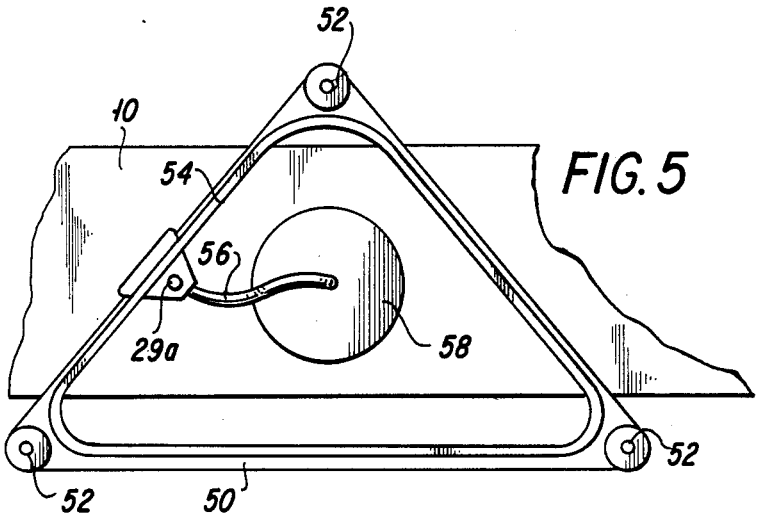
FIG. 5 is a plan view of a transverse striping device constructed in accordance with a further embodiment of the invention.

Referring to FIG. 5, a more detailed exemplary embodiment of the transverse striping devices of FIGS. 1 and 2 is shown. The embodiment of FIG. 5 is generally similar to that of FIGS. 1 and 2, although only a single nozzle, denoted 29*a*, is shown for purposes of simplicity. As illustrated in FIG. 5, a carrier chain 50, generally corresponding to carrier member 27 of FIG. 2, is provided which configured as a triangle and supported driven by a drive and support arrangement comprising three sprockets 52 located at the apices of the triangle formed by chain 50. Chain 50 provides movement of nozzle 29*a* along a triangular path in cooperation with a triangular guide 54. Dye is fed to nozzle 29*a* through a flexible hose or tube 56 from a dye tank or reservoir 58. Thus, in the operation of the embodiment of FIG. 5 in an overall system such as that of FIGS. 1 and 2, while the fabric sheet 10 is being moved past dyeing station 18, nozzle 29*a* is guided by guide 54 along a triangular path and, by controlling the rate of movement of nozzle 29*a* relative to sheet 10, a transverse stripe will be produced. For example, if the triangular path followed by nozzle 29*a* defines an equilateral triangle and if sheet 10 moves at a rate or velocity "v", movement of a nozzle 29*a* at a velocity 2*v* will produce an orthogonal stripe on sheet 10. Further, different relative speeds will produce stripes at different angles relative to the sheet 10 in the finished product.

Figure 6:
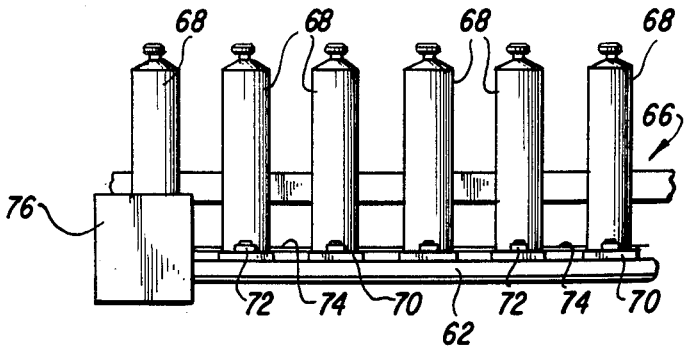
FIG. 6 is a portion of an end view, partially broken away, of a dyeing machine constructed in accordance with yet another embodiment of the invention.
Figure 7:
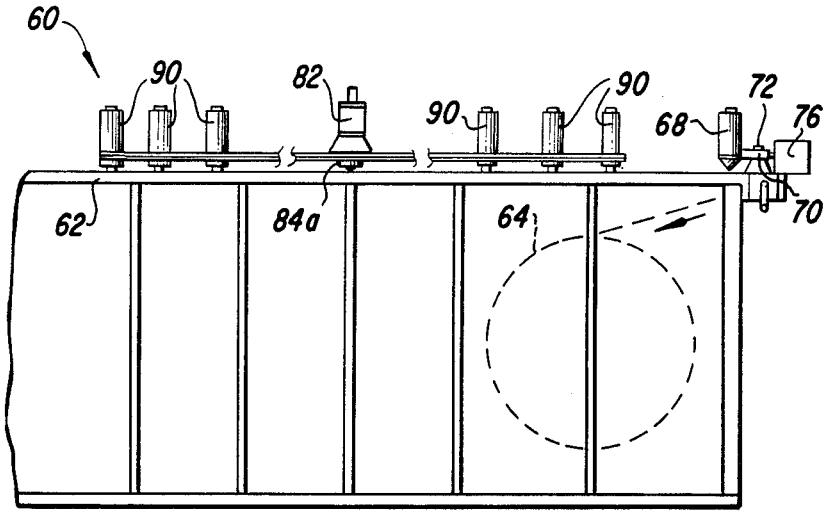
FIG. 7 is side elevation view of the embodiment of FIG. 6.
Figure 8:
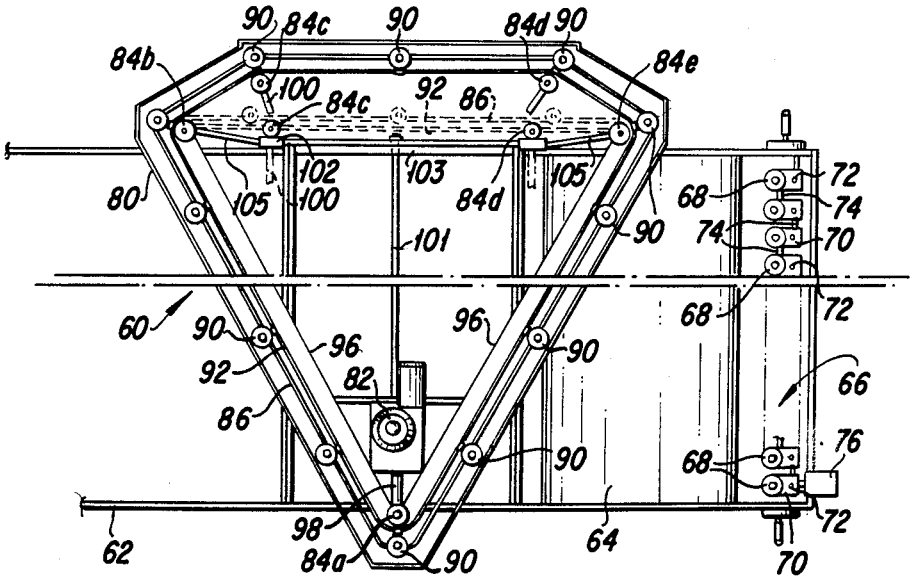
FIG. 8 is a plan view of the embodiment of FIG. 6.

Referring to FIGS. 6 to 8, a further embodiment of the invention as shown. In this embodiment, a transverse striping device, which is denoted 60, is mounted on top of a frame 62 along which the cloth or fabric to be dyed is moved. The cloth or fabric can be contained on a pair of rolls, the downstream or take-up roll being indicated by a dashed line circle 64 in FIG. 7 and the other roll (not shown) being located at the head of frame 62.

A longitudinal striping station, generally denoted 66, comprises a plurality of dyeing nozzles 68 which are arranged in a row extending orthogonally to the path of travel of the cloth and which are each secured to individual pivotable mounting plates 70 as indicated in FIG. 8. Plates 70 are each mounted for rotation about an associated pivot axis 72 and, as illustrated, plates 70 are connected together by a series of links 74 such that the plates 70, and thus the dyeing nozzles 68, can be made to rotate or pivot together. A drive mechanism for controlling this pivoting motion, and thus providing oscillation of the nozzles 68, is indicated schematically at 76 and can be either manually automatically controlled. It will be appreciated that drive mechanism 76 can take the form of a suitable gearing arrangement or other mechanical drive which will provide pivoting of the adjacent plate 70 about the pivot axis 72 thereof so as to provide pivoting of the other plates 70 through connecting links 74. As discussed above, such pivoting movement of the dyeing nozzles 68 relative to the cloth passing thereby will produce "wavy" lines of the type shown in FIG. 4(*a*).

The transverse striping device 60 can best be seen in FIGS. 7 and 8 and includes a generally triangular housing 80 within which a drive motor 82 is mounted. Motor 82 drives a drive sprocket 84*a* which, in turn, drives a drive chain 86 and which is located at one corner of chain 86 as illustrated in FIG. 8. Four additional sprockets 84*b*, 84*c*, 84*d* and 84*e* are located at the other corners of the chain 86 so as to support chain 86 in the generally triangular configuration shown in solid lines in FIG. 8. As indicated schematically in FIG. 8 and shown in more detail in connection with FIG. 10, dyeing nozzles 90 are secured to chain 86 for movement therewith and engage guide arrangement 92 which is of the same generally triangular configuration as the chain 86 so that the nozzles are guided along the path defined by guide arrangement 92.

Sprockets 84*a* to 84*e* are supported by a framework 94 including bridge members 96 and beams 98, 101, 103 and 105, which also supports motor 82. Sprockets 84*a*, 84*b* and 84*e* are fixed in position and are located at the corners of a triangle and sprockets 84*c* and 84*d* are adjustable in position between the location indicated at solid lines wherein the chain 86 forms a generally triangular five-sided figure and the location indicated in dashed lines, wherein chain 86 forms a triangle and the side of chain 86 opposite sprocket 84*a* is substantially straight, as illustrated. Sprockets 84*c* and 84*d* are mounted on one end of corresponding extensible and retractable beams 100 in suitable mountings 102 so that the beams 100, and thus the sprockets 84*c*, and 84*d*, can be extended and retracted between the positions shown in solid lines and the positions shown in dashed lines. As explained below, guide 92 is also adjustable, with movement of sprockets 84*c* and 84*d*, between the solid line and dashed positions shown in FIG. 8 and can thus accomodate the two extreme positions of chain 86 illustrated. In this way, the tension on chain 86 can be adjusted between a maximum (the solid line position) and a minimum (the dashed line position). As discussed above in connection with the other embodiments, the dyeing patterns produced can be varied by controlling the speed of motor 80 which drives the nozzles 90.

Referring to FIGS. 9 and 10, some details of one of the dyeing nozzles 90 and the mounting therefor are shown. It will be appreciated the dyeing nozzles 90 are per se very similar to dye nozzles 68 of longitudinal striping device 66 but that the mountings therefor are different. Thus, before considering the mounting arrangement for a typical dyeing nozzle 90, the vessel itself will be considered. Dyeing nozzle 90 (and similarly, dyeing nozzle 68) comprises a housing or vessel 106 which serves as a reservoir for the dye and includes a generally conical lower end portion 108 which forms the ejection nozzle through which the dyestuff is ejected. A cover 110 is provided at the other end of vessel 106, and a central elongate needle member 112 is mounted in cover 110 by a threaded knob 114. Knob 114 is threadably received in cover 110 so that the longitudinal position of the distal or free end of needle 112 can be manually controlled so as to control the amount of dyestuff ejected through the lower nozzle portion 108. FIGS. 9 and 10 also illustrate a portion of the cloth or fabric to be dyed, denoted 116, passing over a portion of the frame 62.

Considering the mounting and drive arrangement for nozzles 90, and referring particularly to FIG. 10 wherein spindle 84*a* of FIGS. 7 and 8 is also shown, a hanger or mounting bracket 118 including a pair of gripping arms 118*a* and 118*b* supports vessel 90 and carrier chain 86 as well as an upper, inwardly extending guide roller 120. Chain 86 is engaged by the upper drive teeth 122 of sprocket 84*a* while the lower drive teeth 124 of sprocket 84*a* engage a further, drive chain 126 which is driven by the drive sprocket (not shown) of motor 82. Sprocket 84*a* is mounted by bearings 128 for rotatation around a central spindle or shaft 132 which is mounted at the apex of bridge members 96 (see also FIG. 8), and is affixed to frame 62 by lower portion 132 (shown broken away in FIG. 10). Shaft 132 also extends through a further support member 130, located between bridge member 96 and sprocket 84*a*, which supports a U-shaped guide rail 134 of nozzle guide member 92. As illustrated, roller 120 rides on the upper edge of guide rail 134 and is guided thereby.

Portions of guide rail 134 of guide arrangement 92 corresponding to the solid and dashed line portions of FIG. 8 are shown FIGS. 11 and 12. These figures illustrate the manner in which the guide rail 134 can be adjusted between the angled, maximum tension configuration shown in FIG. 11 and the generally flat, minimum tension configuration shown in FIG. 12 by means of a pivoting connection indicated at 136. Further, as shown in FIG. 13, the length of guide rail 134 of guide arrangement 92 can also be varied using the adjustable arrangement, including adjustment bolts 138 and slots 140, which is illustrated so as to accomodate the different settings shown in FIG. 11 and 12.

Although the invention has been described relative to exemplary embodiments thereof, it will be understood by those skilled in the art that variations and modifications can be effected in the exemplary embodiments without departing from the scope and spirit of the invention.

I claim:

1. A dyeing machine comprising:

a first dyeing station;

a second dyeing station;

means for moving a cloth to be dyed along a predetermined path of travel past said first and second stations;

transverse striping means at one of said stations for selectively applying transverse striping to said cloth;

longitudinal striping means at the other of said stations for selectively applying longitudinal striping to said cloth;

said transverse striping means including at least one movable dyeing nozzle, a generally triangular guide disposed relative to the path of travel of said cloth so as to guide the movement of the dyeing nozzle in relation to the cloth so as to enable dyeing of the cloth by the said at least one nozzle; means for moving said nozzle along said guide at a speed related to the speed of movement of the cloth such as to provide transverse striping of the cloth by said at least one nozzle; and said longitudinal striping means comprising a plurality of dyeing nozzles arranged in a row extending transversely to the path of travel of said cloth.

2. A dyeing machine as claimed in claim 1 wherein said dyeing nozzles are disposed above the path of travel of the cloth.

3. A dyeing machine as claimed in claim 2 wherein said nozzles each comprise a reservoir for holding the dyestuff to be applied, a lower nozzle portion which is in communication with said reservoir and which includes a nozzle outlet through which the dyestuff is ejected and means for adjusting the amount of the dyestuff ejected through the nozzle outlet of said nozzle portion.

4. A dyeing machine as claimed in claim 3 wherein said adjustment means comprises an elongate needle and a control knob connected to one end of said needle and located at the upper end of the nozzle for varying the longitudinal position of said needle relative to the nozzle outlet.

5. A dyeing machine as claimed in claim 1 wherein said dyeing nozzles are disposed below the path of travel of the cloth.

6. A dyeing machine as claimed in claim 5 wherein said nozzles include a reservoir for the dyestuff to be applied and a pump for pumping the dyestuff from the reservoir through said nozzles.

7. A dyeing machine as claimed in claim 1 wherein said at least one nozzle of said transverse striping means is mounted on a carrier chain, and said drive means includes a drive sprocket and a drive motor for driving said carrier chain.

8. A dyeing machine as claimed in claim 7 wherein said chain is supported so as to form a triangle, said drive sprocket being located at one apex of the triangle and two further sprockets being located at the other apices of the triangle.

9. A dyeing machine as claimed in claim 8 wherein said two further sprockets are fixed in position and two additional adjustable sprockets are provided whose positions are variable so as to adjust the tension on said chain.

10. A dyeing machine as claimed in claim 9 wherein said guide means is adjustable to accomodate adjustments of the positions of said adjustable sprockets.

11. A dyeing machine as claimed in claim 1 wherein said nozzles of said longitudinal striping means are mounted on individual mounting supports, said longitudinal striping means further comprising link means for linking said mounting supports together for movement thereof in unison and means for providing such oscillatory movement of said support members and thus said nozzles.

12. A dyeing machine for applying stripes to a web of material, said machine comprising:

means for moving a web of material to be dyed along a predetermined path; and transverse striping means for applying transverse stripes to said web, said striping means comprising a plurality of dyeing nozzles, means for connecting said nozzles together in spaced relationship in a generally triangular configuration the base of which lies adjacent the path of travel of the web and the other two sides of which extend across the path of travel of said web, drive means drivingly connected to said connecting means for moving said nozzles in sequence along a triangular path defined by said connecting means across the web at a predetermined speed relative to speed of said web such that said nozzles selectively apply a transverse stripe to said web during the movement thereof along said other sides across the cloth.

13. A dyeing machine as claimed in claim 12 wherein said transverse striping means further comprises a generally triangular guide for guiding the movement of said nozzles.

14. A dyeing machine as claimed in claim 13 wherein said connecting means comprises a drive chain and said drive means comprises a drive sprocket located at one apex of said triangle.

15. A dyeing machine as claimed in claim 14 further means for adjusting the tension on said drive chain.

16. A dyeing machine as claimed in claim 15 wherein said tension adjusting means comprises at least one auxilliary adjustable sprocket the position of which can be varied to vary to tension on said drive chain.

17. A dyeing machine as claimed in claim 16 further comprising means for adjusting said triangular guide so as to accomodate changes in the position of said adjustable sprocket.

18. A dyeing machine as claimed in claim 13 wherein said nozzles each include a laterally extending roller member which rides on said triangular guide.

19. A dyeing machine as claimed in claim 13 wherein said nozzles are directed upwardly toward said web and said striping means includes means for selectively pumping dyestuff through said nozzles.

* * * * *